US005867864A

United States Patent [19]

Miller et al.

[11] Patent Number: 5,867,864

[45] Date of Patent: Feb. 9, 1999

[54] HAND HELD TURBINE POWERED EXTRACTOR NOZZLE

[75] Inventors: Daniel R. Miller, Massillon; A. Ronald Keebler, North Canton; Douglas E. Gerber, North Canton; Douglas C. Barker, North Canton, all of Ohio

[73] Assignee: The Hoover Company, North Canton, Ohio

[21] Appl. No.: 850,611

[22] Filed: May 2, 1997

[51] Int. Cl.[6] ..... A47L 9/04

[52] U.S. Cl. ..... 15/387; 15/322

[58] Field of Search ..... 15/321, 322, 385, 15/387

[56] References Cited

U.S. PATENT DOCUMENTS

| | | | |
|---|---|---|---|
| D. 182,658 | 4/1958 | Guild . | |
| 983,988 | 2/1911 | Foster et al. . | |
| 1,332,235 | 3/1920 | Staples . | |
| 1,848,314 | 3/1932 | Butzer . | |
| 2,032,756 | 3/1936 | Karlstrom . | |
| 2,100,089 | 11/1937 | Smellie . | |
| 2,109,621 | 3/1938 | Kirby . | |
| 2,178,003 | 10/1939 | Smellie . | |
| 2,200,026 | 5/1940 | Juelson . | |
| 2,202,999 | 6/1940 | Smellie . | |
| 2,220,224 | 11/1940 | Faber . | |
| 2,531,370 | 9/1950 | Thompson . | |
| 2,635,277 | 4/1953 | Belknap . | |
| 2,635,278 | 4/1953 | Belknap . | |
| 2,744,272 | 5/1956 | Theis et al. . | |
| 2,881,466 | 4/1959 | Bramhall . | |
| 2,904,816 | 9/1959 | Skolfield . | |
| 2,904,817 | 9/1959 | Brennan . | |
| 2,915,774 | 12/1959 | Darrow . | |
| 2,946,080 | 7/1960 | Burch . | |
| 2,967,314 | 1/1961 | Kowalewski . | |
| 2,972,770 | 2/1961 | Cronhage . | |
| 3,065,489 | 11/1962 | Wright . | |
| 3,192,547 | 7/1965 | Nahrstedt et al. | 15/321 |
| 3,351,972 | 11/1967 | Helm . | |
| 3,688,339 | 9/1972 | Vincent et al. . | |
| 3,849,823 | 11/1974 | Adamson et al. | 15/387 |

(List continued on next page.)

FOREIGN PATENT DOCUMENTS

| | | |
|---|---|---|
| 0 663 176 A1 | 7/1995 | European Pat. Off. . |
| 1 445 160 | 8/1976 | United Kingdom . |
| 2 154 432 | 9/1985 | United Kingdom . |

OTHER PUBLICATIONS

Sharp vacuum cleaner, Model EC–7310, EC 7410 Operation Manual (see p. 1). (No Date).

*Primary Examiner*—Terrence R. Till

*Attorney, Agent, or Firm*—A. Burgess Lowe; Bruce P. Watson

[57] ABSTRACT

A compact, hand held carpet and upholstery extractor nozzle is provided having a pair of air turbine powered vertical axis rotary scrub brushes located adjacent the extractor nozzle. The turbine has at least one ambient air inlet and an outlet that communicates with a suction tube extending from the extractor nozzle. A compact gear reduction operatively connects the air turbine to the scrub brushes. A turbine outlet baffle is preferably provided that extends from an upstream edge of the turbine outlet, into the suction tube and over and beyond the turbine outlet to direct air, liquid and debris flowing through the suction tube over and beyond the turbine outlet opening. A downstream end of the baffle is open and suction openings pass through the baffle, for providing fluid communication between the suction tube and the turbine outlet opening. A raised floor is preferably located in the suction tube upstream of the baffle that directs the flow of air, liquid and debris in the suction tube substantially past the suction openings. A shoulder is preferably provided on each side of the baffle that extends generally longitudinally in the suction tube below the suction openings. The upstream ends of these shoulders curve upward until the shoulders are substantially flush with raised floor. With this construction, any drops of liquid adhering to the raised floor and traveling toward the baffle, will adhere to the shoulders and be directed below the suction openings.

42 Claims, 4 Drawing Sheets

U.S. PATENT DOCUMENTS

| | | | |
|---|---|---|---|
| 4,146,944 | 4/1979 | Pinto . | |
| 4,167,798 | 9/1979 | Klugl et al. . | |
| 4,305,176 | 12/1981 | Lessig, III et al. . | |
| 4,306,330 | 12/1981 | Jinkins . | |
| 4,538,322 | 9/1985 | Ahlf et al. | 15/387 |
| 4,554,702 | 11/1985 | Kochte et al. . | |
| 4,584,736 | 4/1986 | Gremminger . | |
| 4,589,161 | 5/1986 | Kochte et al. | 15/387 |
| 4,733,532 | 3/1988 | Prahl et al. | 15/387 |
| 4,776,058 | 10/1988 | Garner et al. . | |
| 5,008,973 | 4/1991 | Worwaq . | |
| 5,088,149 | 2/1992 | Berg et al. | 15/387 |
| 5,293,665 | 3/1994 | Worwag . | |
| 5,341,541 | 8/1994 | Sham . | |
| 5,345,650 | 9/1994 | Downham et al. . | |
| 5,416,948 | 5/1995 | Worwag . | |

HAND HELD TURBINE POWERED EXTRACTOR NOZZLE

BACKGROUND OF THE INVENTION

1. Field of the Invention

This invention pertains to a compact turbine powered extractor nozzle. More particularly, this invention pertains to a compact hand held air turbine powered extractor nozzle having a pair of gear driven vertical axis scrub brushes.

2. Description of the Prior Art

It is known in the prior art to provide either extractor nozzles or scrubbers with turbine powered agitators or brushes. These prior art turbine powered extractor nozzles and scrubbers are typically large floor cleaning power heads that are designed for attachment to the end of an elongate handle or suction wand by which the operator pushes and pulls the power head over the floor. The opposite end of the wand is typically attached to a canister type extractor or wet/dry vacuum cleaner by a flexible suction hose. It is also common to mount such a power head to an ambulant machine such as a walk behind carpet extractor. In either case, the existing extractor nozzles with turbine powered agitators are typically too large, heavy and cumbersome for hand held, above the floor use required to effectively and easily clean stairs or upholstery, for example.

SUMMARY OF THE INVENTION

An object of the present invention is to provide a compact hand held extractor nozzle having powered scrub brushes.

A further object of the present invention is to provide a lightweight, inexpensive extractor nozzle with powered brushes suitable for hand held use.

A further object of the present invention is to provide a hand held extractor nozzle having powered scrub brushes that are driven by non-electrical means to eliminate the danger of electrical shock when using the nozzle.

A further object of the invention is to provide compact hand held extractor nozzle, having air turbine powered scrub brushes.

The foregoing and other objects of the present invention, that will be readily apparent from the following description of a preferred embodiment and the attached drawings, are achieved in a preferred embodiment of the present invention by providing an extractor nozzle having air turbine powered scrub brushes. The turbine has at least one ambient air inlet and an outlet that communicates with a suction tube extending from the extractor or wet pickup suction nozzle. The turbine drives a pair of vertical axis rotary scrub brushes located adjacent the extractor nozzle. A compact gear reduction operatively connects the air turbine to the scrub brushes. The nozzle is preferably provided with a trigger actuated spray head for selectively applying cleaning liquid to a surface to be cleaned.

In one form of the present invention, an extractor nozzle is provided having an air turbine powered agitator, in which the turbine has at least one ambient air inlet and an outlet that communicates with a suction tube extending from the extractor or wet pickup suction nozzle. A turbine outlet baffle is provided that extends from an upstream edge of the turbine outlet, into the suction tube and over and beyond the turbine outlet to direct air, liquid and debris flowing through the suction tube over and beyond the turbine outlet opening. A downstream end of the baffle is open, providing fluid communication between the suction tube and the turbine outlet opening. Suction openings are also provided in the sides of the baffle to increase the flow of air through the turbine when suction is applied to the suction tube. In order to substantially prevent liquid and debris flowing through the suction tube from entering the suction openings in the sides of the baffle, a wall is located in the suction tube upstream of the baffle that directs the flow of air, liquid and debris in the suction tube past the openings.

A shoulder is preferably provided on each side of the baffle. These shoulders extend generally longitudinally in the suction tube below the suction openings in the sides of the baffle. The upstream ends of these shoulders extend upstream of the suction openings and curve upward until the shoulders are substantially flush with the wall in the tube upstream of the baffle. With this construction, any drops of liquid adhering to the wall in the tube upstream of the baffle and traveling toward the baffle, will adhere to the shoulders in the sides of the baffle and be directed below the suction openings in the sides of the baffle.

The suction openings in the sides of the baffle are preferably slots that extend longitudinally in the suction tube and that are open at the downstream end of the baffle.

BRIEF DESCRIPTION OF THE DRAWINGS

The invention will now be described, by way of example, with reference to the attached drawings, of which.

DETAILED DESCRIPTION OF THE PREFERRED EMBODIMENT

Figure 1:
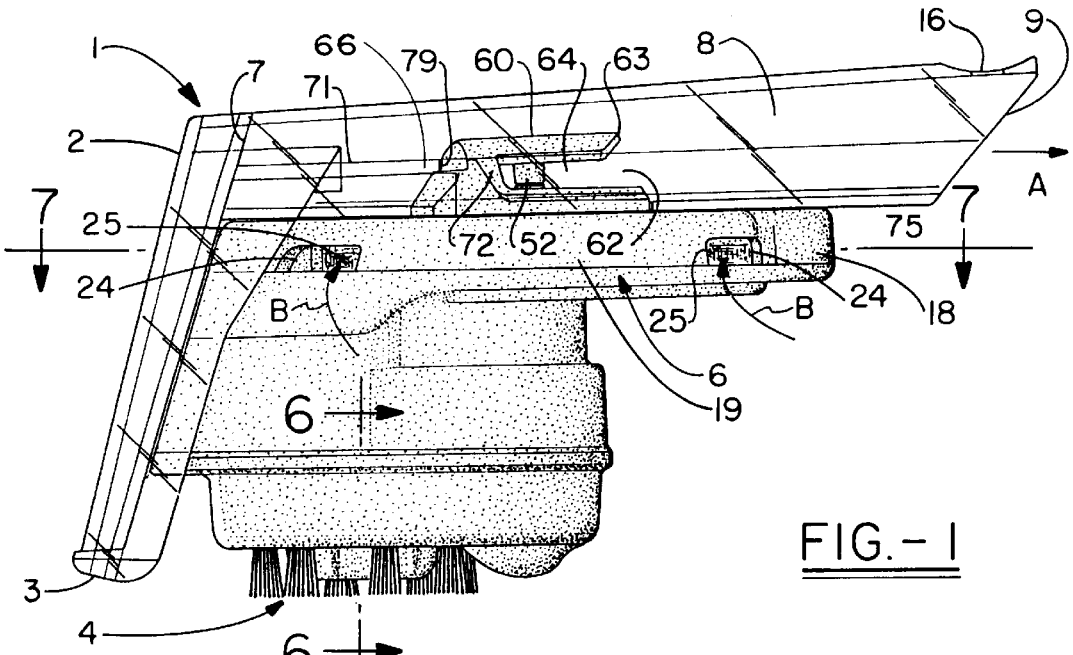
FIG. 1 is a side elevational view of a compact hand held turbine power extractor nozzle according to the present invention.
Figure 2:
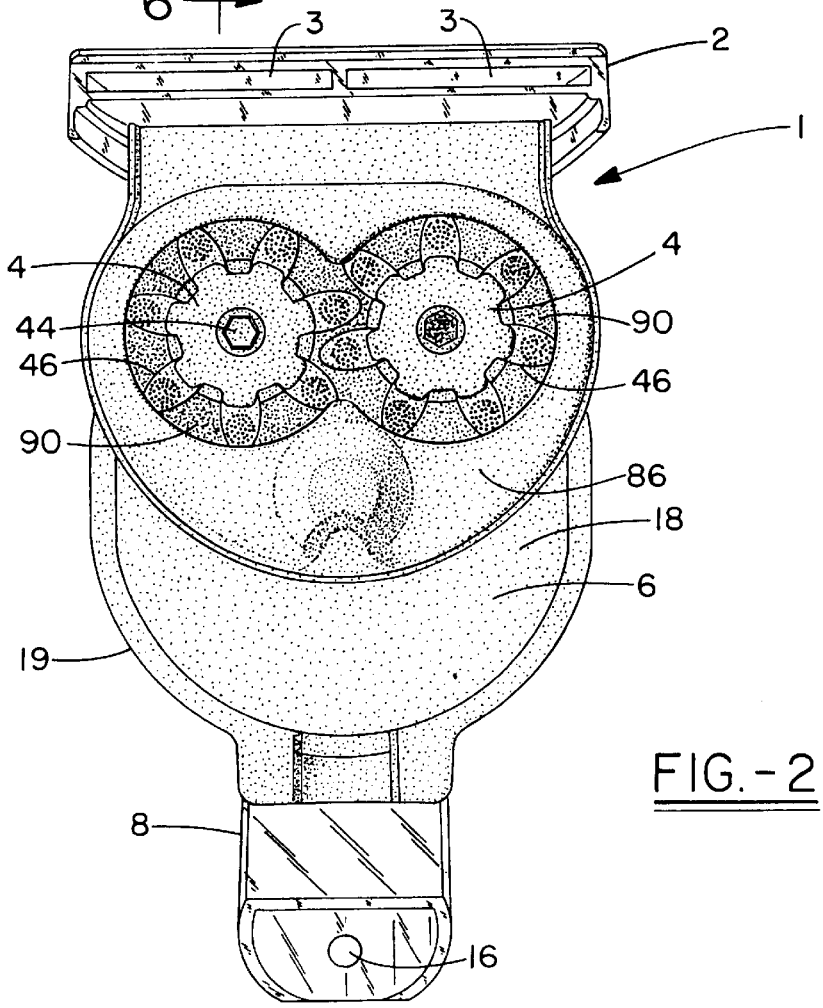
FIG. 2 is a bottom view of the nozzle illustrated in FIG. 1.
Figure 3:
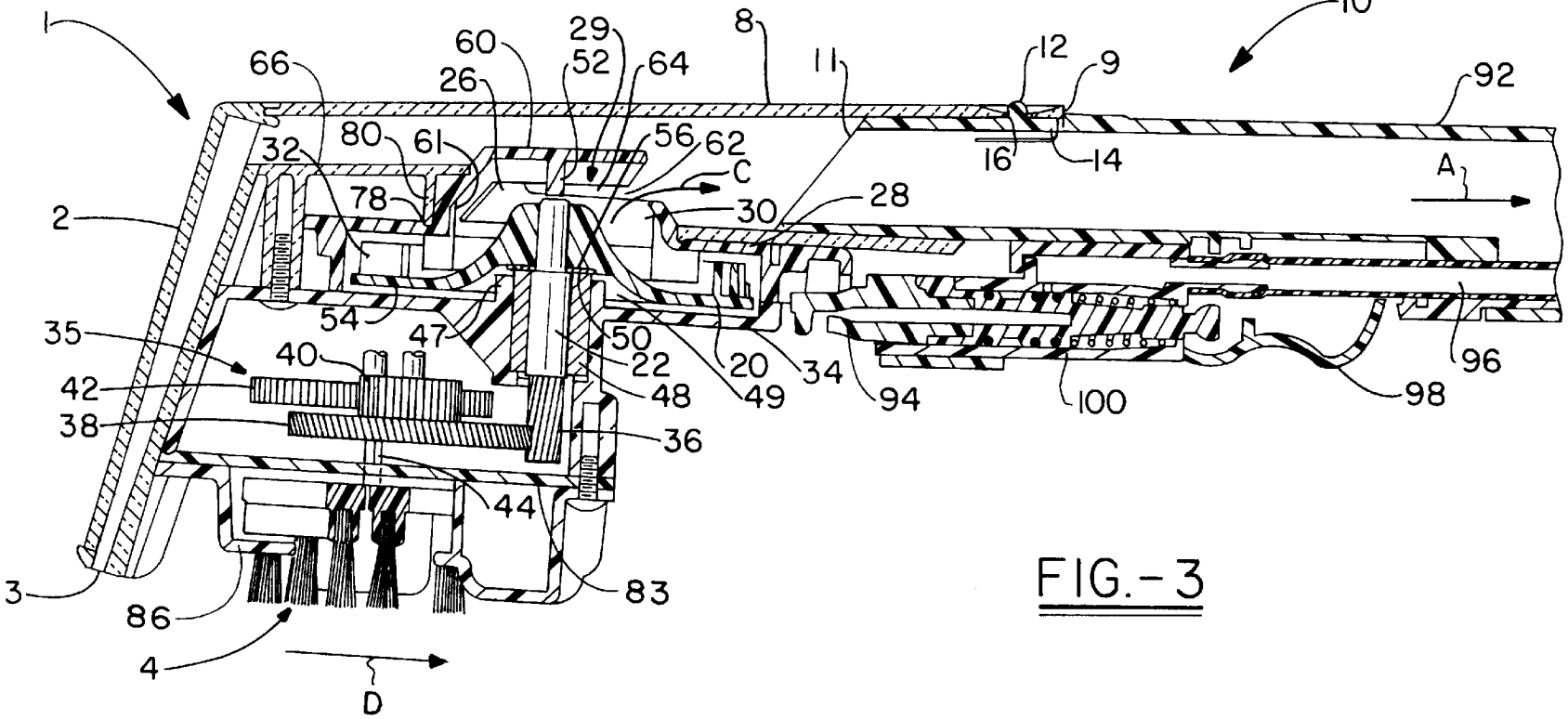
FIG. 3 is a longitudinal cross section of the nozzle illustrated in FIG. 1 attached to a hand held spray and suction wand.

Referring now to FIGS. 1 through 3, a hand held power extractor nozzle, generally indicated as 1, according to one form or embodiment of the present invention, includes an extractor nozzle 2 and at least one, but preferably a pair of counter-rotating vertical axis rotary scrub brushes 4 that are driven by an air powered turbine 6.

The extractor nozzle 2 has a narrow, elongate nozzle inlet 3 for extracting liquid from a surface to be dried or cleaned and is fixed to a first end 7 of a suction tube 8. A second end 9 of the suction tube is shown mounted to an outer end 11 of a hand held suction and spray wand 10 in FIG. 3. A flexible suction hose (not shown) connects the opposite end of the wand 10 to an extractor or other wet pickup suction cleaner (not shown) such as, for example, disclosed in commonly owned U.S. Pat. No. 5,493,752 entitled Upright Carpet and Upholstery Extractor issued on Feb. 27, 1996, the description of which is hereby incorporated herein as of reference. In order to releasably retain the power nozzle 1 on the end of the hand held wand 10, a retaining nub 12 extending from a resilient tab 14 integrally formed in the end of the hand held wand resiliently engages a through hole 16 in the suction tube 8. The power nozzle is released from the wand by depressing the nub 12 and pulling the nozzle off the wand.

The turbine 6 and the brushes 4 are mounted to the suction tube 8 adjacent to the nozzle 2 by screws or other suitable fastening means. The turbine includes a relatively flat generally disc or pancake shaped turbine housing 18 defining a generally disc or pancake shaped turbine chamber therein. A generally disc shaped turbine rotor 20 is rotatably mounted in the turbine housing 18 on an axle 22. The turbine housing 18 is defined by an upper end wall 28 and a lower end wall 34 connected by a peripheral wall 19 enclosing the turbine chamber.

A plurality of turbine inlet openings 24 pass through the peripheral wall 19 of the turbine housing 18 and a turbine outlet opening 26 passes through a center of the upper wall 28 of turbine housing. The turbine outlet opening 26 communicates an eye 29 of the turbine 6 with a turbine exhaust opening 30 passing through a lower side of the suction tube 8, such that when suction is applied to the suction tube, as indicated by arrow A, ambient air is drawn in through the turbine inlet openings 24, as illustrated by arrow B, through turbine blades 32 on the turbine rotor 20 and out through the turbine outlet opening 26, as indicated by arrow C, thereby driving the turbine rotor. Screens 25 are preferably mounted in the turbine inlet openings to prevent dust, lint and other debris from being drawn in the inlet openings and fouling the turbine.

The terms upper and lower are used in relation to the power nozzle 1 as illustrated in FIGS. 1 and 3 with upper meaning toward the suction tube 8 and lower meaning toward the brushes 4. Likewise, the term forward means toward the nozzle 2 and rearward means toward the wand 10. It can be appreciated that the orientation of the power nozzle 1 changes during use. As such, the terms upper, lower, forward and rearward, as used in the description and the appended claims, are only intended to describe the parts of the nozzle when the nozzle is in the orientation illustrated in FIGS. 1 and 3 with the brushes 4 and nozzle inlet 3 facing down.

Figure 4:
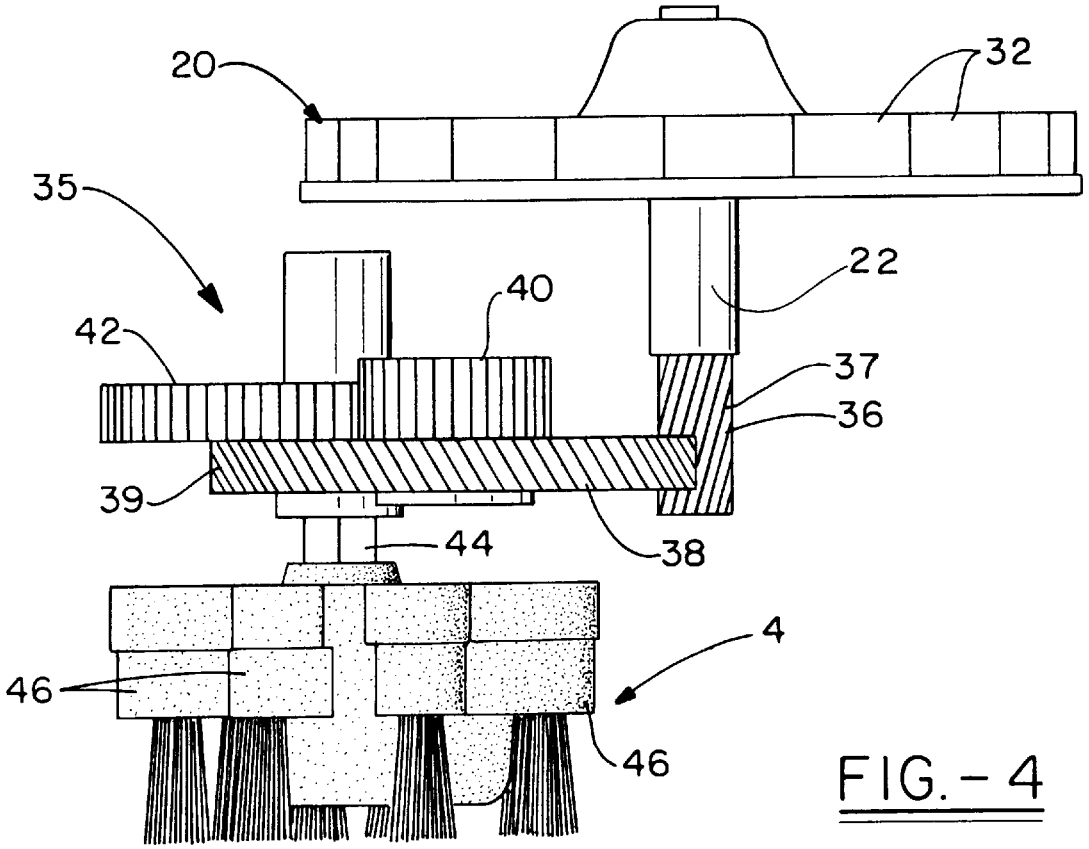
FIG. 4 is a diagrammatic illustration of the drive train used to drive the brushes.

Referring now to FIGS. 3 and 4, a portion or first end of the turbine axle 22 extends through the lower wall 34 of the turbine housing 18 and drives the brushes 4 via a gear train 35. The gear train is preferably a conventional gear reduction. The portion of the axle outside the turbine housing has helical gear teeth 37 formed integrally therewith forming a gear shaft 36. The helical teeth on the gear shaft 36 engage helical gear teeth 39 on an outer periphery of an idler or reducing gear 38, such that the idler gear 38 is driven by the turbine rotor 20. A reduced diameter portion 40 of the idler gear engages and drives a spur gear 42. A drive shaft 44 is integrally formed with the spur gear. The drive shaft 44 has a non-circular cross section that is non-rotatably received in a correspondingly sized and shaped central opening in one of the brushes 4 for rotationally driving the brushes. The outer periphery of the brushes have gear teeth 46 integrally formed thereon. The brushes are mounted side by side such that the gear teeth 46 on the brushes intermesh whereby the driven brush drives the non-driven brush.

Figure 7:
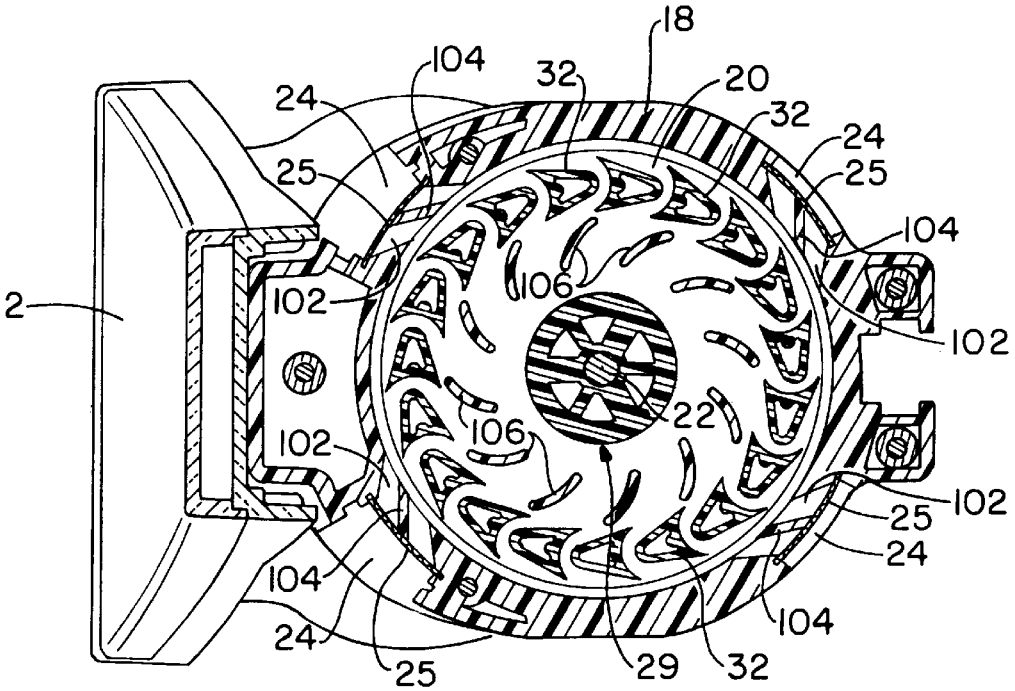
FIG. 7 is a horizontal cross-section through the turbine, taken along line 7—7 in FIG. 1.

In order to rotatably mount the turbine rotor 20 in the turbine housing 18 with minimal friction, the axle 22 is mounted in the lower end wall 34 in a sleeve bearing 48 and a thrust washer 50 is mounted over the axle between the rotor 20 and the sleeve bearing. Furthermore, a pin 52 formed of wear resistant material extends down from a turbine exit shroud or baffle 60 to make a substantially point contact with a top end of the axle when the rotor is drawn upward by the suction A applied to the tube 8. In addition, the direction in which the helical teeth on the gear shaft 36 twist about the shaft is selected such that the engagement of the gear shaft with the idler gear 38 creates a downward force on the shaft and therefore on the turbine rotor 20 under load. This downward force counterbalances the upward force applied to the rotor 20 by the suction A in the suction tube. More particularly, the turbine 32 blades on the rotor 20 are designed to cause the rotor to spin clockwise in top view (see FIG. 7) and the helical teeth on the gear shaft have a right hand or clockwise twist, such that clockwise motion of the rotor causes the idler gear 38 to apply a downward force on the gear shaft 36.

The diameters of the idler and spur gears are preferably selected to achieve a gear reduction ratio of about 20 to 1 from the turbine rotor 20 to the brushes 4. It can be appreciated that the optimum gear reduction ratio will vary depending upon the desired speed and power of the brushes and the amount of suction and air flow available for driving the turbine.

The turbine rotor 20 is preferably somewhat bell shaped. The bell shape facilitates the flow of air through the turbine 6 and out the turbine outlet opening 26 by smoothly guiding the flow of air upward and out the turbine outlet opening 26. The bell shape also minimizes distortion of the rotor 20 under load. An additional benefit of the bell shape of the turbine rotor is provided by a recess 49 in a lower side 54 of the rotor as viewed in FIG. 3. The sleeve bearing 48 supporting the turbine axle in the lower end wall 34 is preferably located in a central raised portion 47 of the lower end wall 34, such that the top end 56 of the bearing is received in the recess 49 in the lower side of the turbine. Locating the sleeve bearing partially in the recess in the rotor decreases the vertical height required to mount rotor 20 and axle 22 in the housing 18 and provides a relatively compact construction. Locating the top end of the bearing above the lower end wall 34 also helps prevent any liquid pooling on the lower end wall 34 from entering the bearing 48. Any liquid that pools on the lower end wall 34 will run out the turbine inlet openings 24 when the suction being applied to the suction tube is turned off.

Figure 5:
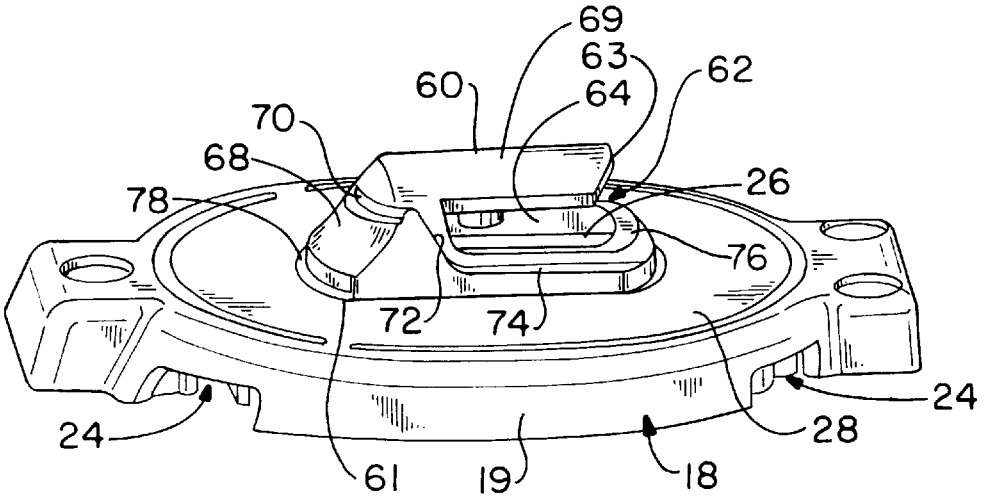
FIG. 5 is a perspective view of the turbine outlet baffle on the nozzle of FIG. 1.

Referring now to FIG. 3 and primarily FIG. 5, in order to prevent liquid and other debris suctioned in the nozzle 2 and traveling through the suction tube 8 from entering the turbine outlet opening 26 and fouling the turbine rotor 20, a turbine outlet shroud or baffle 60 is integrally formed on the turbine housing 18. Only the top half of the turbine housing is illustrated in FIG. 5. The baffle 60 has a first portion 68 that extends generally upward from a forward or upstream edge 61 of the turbine outlet opening and a second or roof portion 69 that extends downstream in the suction tube 8 over and beyond the outlet opening in order to direct the air, liquid and debris flowing through the suction tube over and beyond the turbine outlet opening. The rearward or downstream end 63 of baffle 60 is open at 62, such that suction applied to the tube 8 draws air through the turbine outlet opening 26. To ensure sufficient air flow through the baffle 60 to drive the turbine rotor and the brushes 4, suction openings, preferably in the form of slots 64, pass through either side of the baffle to enlarge the rearward opening 62 and increase the area through which the suction in the tube 8 draws air out the turbine outlet opening. Increasing the area of the rearward opening of the baffle 60 increases the rate of air flow through the turbine 6, thereby increasing the speed and power of the brushes 4.

A first portion or upstream wall 68 of the baffle 60 is inclined to minimize the turbulence caused in the stream of liquid, air and debris flowing through the suction tube, when this stream is deflected by the baffle over and beyond the turbine outlet opening 26. It is preferred that a portion of the suction tube 8 forward or upstream of the baffle 60 has a raised floor or wall 66 that is raised above the slots 64 and is generally level with the top of the baffle, in order to further minimize the turbulence created in the flow of air, liquid and debris flowing in the suction tube over the baffle. The raised floor 66 also directs the flow of air, liquid and debris in the suction tube above the slots 64.

The raised floor 66 further serves to restrict the cross-sectional area of the portion of the suction tube 8 upstream of the baffle 60, i.e., between the baffle and the suction nozzle 2, relative to portion of the suction tube 8 downstream of the baffle 60. This restriction of the upstream or forward portion of the suction tube partially throttles the flow of air through the suction nozzle causing more air to be drawn through the turbine 6, thereby providing more power for driving the brushes 4. A rearward or downstream edge 79 (see FIG. 1) of raised floor 66 is matingly received within a recessed shoulder 70 in the forward inclined wall 68 of the baffle.

The flow of air through the suction nozzle 2 is partially throttled when the nozzle inlet 3 is pressed against a surface to be cleaned. Therefore, in order to achieve satisfactory brushing and extraction, the cross-sectional area of the nozzle inlet, the suction tube 8 upstream and downstream of the baffle 60 and the turbine inlets 24 and outlet 26, as well as the turbine blades 32, have been designed to balance the suction and air flow available for extraction with the nozzle 2 and the suction and air flow available for driving the brushes 4 with the turbine when the nozzle inlet 3 is pressed against a surface to be cleaned. It will be appreciated that maximum suction and air flow will be applied to the turbine when the nozzle inlet is pressed against a surface. Thus, the brushes will be at maximum power when the brushes and the nozzle inlet are simultaneously pressed against a surface to be cleaned.

Shoulders 74 on opposite sides of the baffle 60 extend generally longitudinally in the suction tube 8 below the slots 64. Portions 72 of the shoulders 74 upstream of the slots 64 curve upward until the forward or upstream ends of the shoulders 74 are substantially flush with an inner surface 71 (see FIG. 1) of the raised floor 66. With this construction, any drops of liquid adhering to the inner surface of the raised floor and traveling toward the baffle will adhere to the shoulders and be directed below and beyond the slots 64. Thus, drops of liquid on the raised floor 66 are substantially prevented from entering the slots and fouling the turbine.

The rear opening 62 and the slots 64 in the baffle 60 are slightly raised above the lower inner surface 75 (see FIG. 1) of suction tube 8 by a surrounding wall or dam 76. The wall 76 serves to substantially prevent liquid and debris remaining in the suction tube 8 after the suction being applied to the suction tube is turned off from entering the turbine outlet opening 26 and fouling the turbine. A recessed groove 78 in the upper end wall 28 of the turbine housing 18 surrounds the surrounding wall 76 and receives therein a flange or lip 80 extending downward from the lower wall of the suction tube 8 to provide a substantially air and liquid tight seal between the suction tube and the upper end wall 28 of the turbine housing 18.

The suction nozzle 2 and the suction tube 8 are preferably formed out of a transparent plastic material, so that the operator may visually observe the flow of soiled cleaning solution and debris in the suction nozzle and the suction tube.

Figure 6:
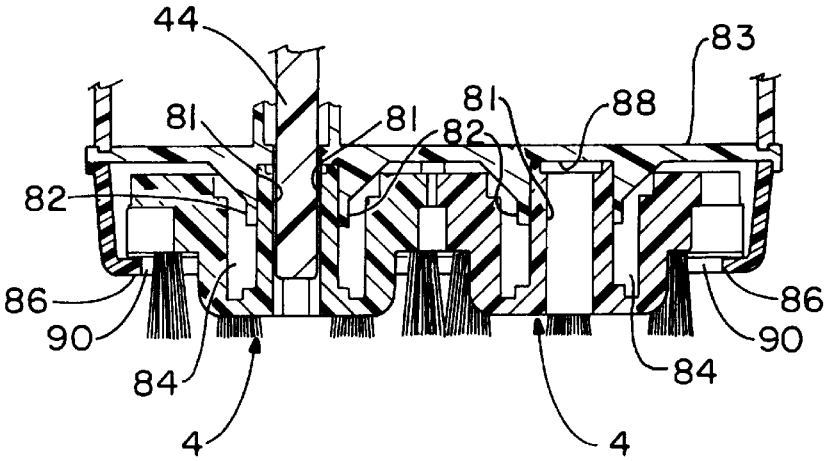
FIG. 6 is a cross-sectional view of the brush chamber illustrating how the brushes are mounted in the nozzle.

Referring now to FIG. 6, the brushes 4 each have bearing and brush mounting stems 81 integrally formed therewith. The brush bearing and mounting stems 81 are received in hollow cylindrical brush mounting posts 82 extending down from a wall 83 separating the brush chamber from the gear chamber. In order to provide a compact brush assembly, the brushes 4 have annular recesses 84 surrounding the stems 81 for receiving the mounting posts 83 therein. The brushes 4 are retained in place on the mounting posts by a lower brush retaining wall 86. The ends of the stems 81 on the brushes 4 abut against an inner end surface 88 inside the mounting posts 82. Thus, the brushes 4 are held axially in place between the end surfaces 88 and the retaining wall 86. Bristles on the brushes 4 extend out brush openings 90 in the retaining wall (as best seen in FIG. 2). The brushes and the manner of mounting the brushes in the nozzle 1 are similar to the brushes and brush mounting arrangement disclosed in commonly owned co-pending U.S. patent application Ser. No. 08/678,496 entitled Carpet Extractor Brush Assembly, filed on Jul. 9, 1996, which is a continuation of Provisional Application Ser. No. 60/003,269 filed on Aug. 11, 1995, the description of which is hereby incorporated herein as of reference.

The turbine powered extractor nozzle 1 of the present invention is illustrated in FIG. 3 as being attached to the hand held spray and suction wand 10. The hand held spray and suction wand 10 includes a suction tube or wand 92 that is preferably attached to the suction inlet of an extractor (not shown) by a flexible suction hose (not shown). The hand held spray and suction wand 10 also includes a cleaning fluid applicator, preferably a spray nozzle 94, that is preferably connected to a cleaning solution or liquid supply pump (not shown) of an extractor by a flexible supply tube 96. A trigger 98 operated valve 100 communicates the spray nozzle with the solution supply tube for selectively spraying cleaning solution out the spray nozzle onto a surface to be cleaned. The wand 92 provides a hand grip by which the operator may grasp the hand held spray and suction wand with a single handle for convenient above floor cleaning. A more detailed description of the spray and suction wand 10 can be found in commonly owned U.S. patent application Ser. No. 08/642,788, filed on May 3, 1996, the description of which is hereby incorporated herein as of reference.

The turbine 6 is similar to the air powered turbines disclosed in commonly owned U.S. Pat. No. 5,443,362 issued on Aug. 22, 1995, entitled Air Turbine and in commonly owned co-pending U.S. patent application Ser. No. 08/677,275, filed on Jul. 9, 1996, now abandoned, which is a continuation of Provisional Application Ser. No. 60/002,205, filed on Aug. 11, 1995, the description of which are hereby incorporated herein as of reference. In particular, as discussed above, the turbine rotor according to the present invention is somewhat bell shaped as disclosed in the above-mentioned co-owned U.S. Pat. No. 5,443, 362. Furthermore, referring now to FIG. 7, the turbine inlet openings 24 have inclined inner stator portions 102 that control the flow of air through the inlet openings, as disclosed in the above-mentioned co-owned U.S. patent application Ser. No. 08/677,275, in place of the conventional multiple stator blade arrangement.

The turbine 6 does not, however, include a volute inlet plenum surrounding the peripheral wall 19 to impart a swirling tangential component to the air before the air enters the inlet openings, as do the turbines disclosed in the above-mentioned patent and patent application. As a result, it is necessary for the inlet openings 24 to impart a tangential component to the air as the air passes through the inlet openings. To this end, an inclined stator vane 104 is located in each of the inlet openings 24. Stator vanes 104 ensure that the air does not pass radially through the inlet openings and radially through the turbine blades 32. The stator vanes 104 and the stator portions 102 of the inlet openings ensure that the air passing through the inlet openings has a tangential component relative the rotor 20, so that the air impinges upon the turbine blades 32 with a tangential component for driving the rotor 20.

The turbine according to the present invention has turbine blades 32 and exit stator or diffuser blades 106 that are substantially the same as the turbine and diffuser blades disclosed in the above-identified application. The number and shape of the turbine blades 32 and the diffuser blades 106 in the turbine nozzle 1 according to the present invention, however, have been altered, compared to the turbine and diffuser blades disclosed in the above-mentioned patent and patent application, according to conventional air turbine theory and design, in order to optimize the performance of the turbine 6 in the present turbine nozzle arrangement. The diffuser blades 106 extend down from upper end wall 28 of the turbine housing 18 to guide the flow of air in the turbine from the turbine blades 32 to the eye 29 of the turbine.

In operation, suction is applied to the suction tube 8, thereby applying suction simultaneously to the suction nozzle 2 and the air powered turbine 6. Thus, air is drawn simultaneously in through the suction nozzle inlet 3 for extracting liquid from a surface to be dried or cleaned and in through the turbine inlet openings 24 for operating the turbine 6 by driving the rotor 20, which in turn, drives the scrub brushes 4 via the gear train 35.

An operator preferably simultaneously presses the suction inlet 3 and the scrub brushes 4 against a surface to be cleaned and then depresses the trigger 98 while pulling the extractor nozzle 1 in a rearward direction as indicated by arrow D in FIG. 3. Upon depressing the trigger, the spray nozzle sprays cleaning solution onto the carpet or other surface to be cleaned. The brushes are then used to distribute the solution on the carpet or fabric and work the solution into the carpet or fabric with a scrubbing action.

By depressing the trigger 98 while moving the nozzle 2 in a rearward direction, the scrub brushes 4 scrub a surface to be cleaned substantially immediately after the cleaning solution is sprayed onto the surface by the spray nozzle 94, and the suction nozzle 2 extracts the soiled cleaning solution from the surface substantially immediately after the surface has been scrubbed by the scrub brushes. In this manner, the cleaning solution is extracted before it has time to penetrate too deeply into the fabric, carpet, or other surface being cleaned to be sufficiently extracted by the nozzle. However, it can be appreciated that for stubborn spots or stains, the spot may be pre-treated by spraying cleaning solution from the spray nozzle onto the spot or stain prior to scrubbing the spot with the scrub brushes and extracting the cleaning solution with the nozzle. Moving the turbine nozzle while spraying also helps prevent over-saturation of the carpet or other surface being cleaned.

The turbine powered extractor nozzle 1 according to the present invention has been illustrated and described in the preferred embodiment as being removably attached to the end of the suction wand 92 of the hand held spray and suction wand 10. However, it can be appreciated that the hand held spray and suction wand may alternatively be formed integrally with the suction tube 8 of the hand held turbine powered extractor nozzle, thereby providing a turbine powered extractor nozzle having an integrally formed trigger actuated spray nozzle.

It can likewise be appreciated that the turbine powered extractor nozzle 1 described above may be connected directly to the end of a suction hose connected to an extractor or to a wet/dry utility vacuum cleaner. In which case, the second end 9 of the suction tube 8 forms a hand grip by which the operator may hold the nozzle 1 when scrubbing and extracting with the nozzle 1. If desired, a separate spray device, such as a spray bottle, may be used to apply cleaning solution to a surface to be cleaned prior to scrubbing and extracting with turbine powered extractor nozzle 1.

It will also be appreciated that the gear train 35 may be any suitable gear train other than the gear reduction illustrated and described above. The gear train 35 may, for example, be a planetary gear reduction arrangement.

Upon reading the above description it will become apparent to one of skill in the art that various modifications may be made to the disclosed preferred embodiment of the invention, without departing from the scope of the present invention as described by way of example above and as set forth in the appended claims.

The invention claimed is:

1. A compact hand held extractor nozzle with at least one powered scrub brush comprising:

a cleaning fluid applicator;

a suction tube having a suction extractor nozzle mounted on one end thereof;

at least one vertical axis rotary scrub brush adjacent to the nozzle;

an air powered turbine located between the scrub brush and the tube, the turbine having at least one turbine inlet communicating with ambient atmosphere and a turbine outlet communicating with the suction tube; and a gear train drivingly connecting the turbine with the brush.

2. A hand held extractor nozzle according to claim 1, wherein the turbine comprises:

a generally disc-shaped turbine housing having a first end wall adjacent and generally parallel to the suction tube, a second end wall parallel to and spaced from the first end wall, and a peripheral wall joining the first and second end walls enclosing a generally disc-shaped turbine chamber; and a generally disc-shaped turbine rotor rotatably mounted in the turbine chamber.

3. A hand held extractor nozzle according to claim 2, wherein said at least one turbine inlet is located in the peripheral wall; and the turbine outlet is centrally located in the first end wall and fluidly communicates an eye of the turbine with the suction tube.

4. A hand held extractor nozzle according to claim 2, wherein the turbine rotor is fixed on an axle that is rotatably mounted in the second end wall.

5. A hand held extractor nozzle according to claim 4, wherein a first end of the axle extends through and beyond the second end wall; and helical gear teeth are provided on the first end of the axle, thereby defining a helical gear shaft that drivingly engages the gear train.

6. A hand held extractor nozzle according to claim 5, wherein the gear train comprises an idler gear having a first driven helical gear portion having a first diameter and an integrally formed reduced diameter gear portion having a second diameter that is smaller than the first diameter; and a spur gear engages and is driven by the reduced diameter portion of the idler gear, and the brush is operatively connected to and is driven by the spur gear.

7. A hand held extractor nozzle according to claim 1, comprising at least two vertical axis rotary scrub brushes.

8. A compact hand held extractor nozzle with at least one powered scrub brush comprising:

a cleaning fluid applicator;

a suction tube having a suction extractor nozzle mounted on one end thereof;

at least one rotary scrub brush adjacent to the nozzle;

an air powered turbine located between the scrub brush and the tube, the turbine having at least one turbine inlet communicating with ambient atmosphere and a turbine outlet communicating with the suction tube;

a gear train drivingly connecting the turbine with the brush;

a generally disc-shaped turbine housing having a first end wall adjacent and generally parallel to the suction tube, a second end wall parallel to and spaced from the first end wall, and a peripheral wall joining the first and second end walls enclosing a generally disc-shaped turbine chamber, the at least one turbine inlet being located in the peripheral wall and the turbine outlet being located centrally in the first end wall;

a generally disc-shaped turbine rotor rotatably mounted in the turbine chamber on an axle rotatably mounted in the second end wall, a first end of the axle extending through and beyond the second end wall; and wherein helical gear teeth are provided on the first end of the axle, thereby defining a helical gear shaft that drivingly engages the gear train, the helical teeth on the gear shaft are twisted about the gear shaft such that, under load, the engagement of the gear shaft with the gear train creates a generally axial force on the axle in a direction away from the turbine outlet.

9. A hand held extractor nozzle according to claim 8, wherein the gear train comprises an idler gear having a first driven helical portion having a first diameter and an integrally formed reduced diameter portion having a second diameter that is smaller than the first diameter; and a spur gear engages and is driven by the reduced diameter portion of the idler gear, and the brush is operatively connected to and is driven by the spur gear.

10. A compact hand held extractor nozzle with at least one powered scrub brush comprising:

a cleaning fluid applicator;

a suction tube having a suction extractor nozzle mounted on one end thereof;

at least one rotary scrub brush adjacent to the nozzle;

an air powered turbine located between the scrub brush and the tube, the turbine having at least one turbine inlet communicating with ambient atmosphere and a turbine outlet communicating with the suction tube;

the brush being drivingly connected to the turbine;

wherein the turbine comprises a generally disc-shaped turbine housing having a first end wall adjacent and generally parallel to the suction tube, a second end wall parallel to and spaced from the first end wall, and a peripheral wall joining the first and second end walls enclosing a generally disc-shaped turbine chamber and a generally disc-shaped turbine rotor rotatably mounted in the turbine chamber on an axle that is rotatably mounted in the second end wall; and wherein a sleeve bearing is mounted in the second end wall and the axle is rotatably mounted in the bearing, wherein a surface of the rotor facing the second end wall has a centrally located recess and the bearing is mounted in a raised portion of the second end wall that extends into the recess, such that the bearing is at least partially received in said recess.

11. A compact hand held extractor nozzle with at least one powered scrub brush comprising:

a cleaning fluid applicator;

a suction tube having a suction extractor nozzle mounted on one end thereof;

at least one rotary scrub brush adjacent to the nozzle;

an air powered turbine located between the scrub brush and the tube, the turbine having at least one turbine inlet communicating with ambient atmosphere and a turbine outlet communicating with the suction tube;

the brush being drivingly connected to the turbine; and wherein the turbine further comprises an outlet baffle for directing air, liquid and other debris traveling through the suction tube over and beyond the turbine outlet to substantially prevent the liquid and debris from entering the turbine outlet and fouling the turbine.

12. A hand held extractor nozzle according to claim 11, wherein the turbine baffle comprises a first portion that extends from an upstream edge of the turbine outlet into the suction tube and a second portion that extends down stream from the first portion over and beyond the turbine outlet, a downstream end of the baffle being open for providing fluid communication between the suction tube and the turbine outlet.

13. A hand held extractor nozzle according to claim 12, further comprising suction openings passing through opposing sides of the baffle for providing further fluid communication between the suction tube and the turbine outlet.

14. A hand held extractor nozzle according to claim 13, further comprising a raised floor in the suction tube upstream of the baffle, the raised floor being positioned and arranged to direct air, liquid and debris traveling through the suction tube past the suction openings in the sides of the baffle.

15. A hand held extractor nozzle according to claim 14, wherein the raised floor is located in a plane that runs generally longitudinally in the suction tube and that is located on a side of the suction openings remote from the turbine;

shoulders are formed in opposing sides of the baffle, the shoulders are located between the suction openings and an inner surface of the suction tube and extend generally longitudinally in the suction tube, portions of the shoulders upstream of the suction openings curve toward the raised floor such that the upstream ends of the shoulders are substantially flush with an inner surface of the raised floor, whereby drops of liquid traveling on the raised floor toward the baffle adhere to the shoulders and are directed around and beyond the suction openings in the baffle.

16. A hand held power extractor nozzle for above floor cleaning comprising:

a cleaning liquid applicator for applying cleaning liquid to a surface being cleaned;

a suction extractor nozzle having a nozzle inlet for removing soiled cleaning liquid from a surface being cleaned and a nozzle outlet;

a suction tube extending from the nozzle outlet;

an agitator for scrubbing a surface to be cleaned; and an air powered turbine for driving the agitator, the turbine being located adjacent to the suction nozzle and between the agitator and the suction tube and the agitator being located intermediate the turbine and a surface to be cleaned, the turbine having at least one turbine inlet in fluid communication with ambient air and at least one turbine outlet communicating with an opening in the suction tube, whereby suction in the suction tube draws ambient air through the turbine for driving the agitator, while simultaneously drawing air through the suction nozzle for removing soiled cleaning liquid from a surface to be cleaned.

17. An extractor nozzle according to claim 16, wherein the turbine comprises a substantially disc-shaped turbine housing arranged in a plane substantially parallel to the suction tube and a substantially disc-shaped turbine rotor rotatably mounted in the turbine housing.

18. An extractor nozzle according to claim 17, further comprising a gear train operatively connecting the turbine rotor to the agitator.

19. An extractor nozzle according to claim 18, further comprising a first end wall of the turbine housing located on a side of the turbine rotor remote from the suction tube, between the turbine rotor and the gear reduction, and a bearing mounted in the first end wall;

wherein the turbine rotor is fixed on an axle that is rotatably mounted in the bearing and that extends through and beyond the first end wall, a portion of the axle extending beyond the first end wall has helical gear teeth provided thereon that engage and drive the gear train, the helical gear teeth being twisted about the axle such that under load the helical gear teeth apply a generally axial load on the axle in a direction away from the turbine outlet.

20. An extractor nozzle according to claim 19, wherein the turbine rotor has a centrally located recess in a surface of the rotor facing the first end wall of the turbine housing, the first end wall has a central raised portion that extends into the recess, and the bearing is mounted in the central raised portion such that the bearing is at least partially received in the recess in the rotor.

21. A hand held power extractor nozzle for above floor cleaning comprising:

a cleaning liquid applicator for applying cleaning liquid to a surface to be cleaned;

a suction extractor nozzle having a nozzle inlet for removing soiled cleaning liquid from a surface to be cleaned and a nozzle outlet;

a suction tube extending from the nozzle outlet;

an agitator for scrubbing a surface to be cleaned; and an air powered turbine for driving the agitator, the turbine being located adjacent to the suction nozzle and between the agitator and the suction tube, the turbine having at least one turbine inlet in fluid communication with ambient air and at least one turbine outlet in fluid communication with an opening in the suction tube, whereby suction in the suction tube draws ambient air through the turbine for driving the agitator, while simultaneously drawing air through the extractor nozzle for removing soiled cleaning liquid from a surface to be cleaned;

the turbine comprises a generally disc-shaped turbine housing arranged in a plane substantially parallel to the suction tube and a generally disc-shaped turbine rotor rotatably mounted in the turbine housing; and the agitator comprises at least two vertical axis rotary scrub brushes.

22. An extractor nozzle according to claim 21, further comprising a gear train operatively connecting the turbine rotor to the brushes.

23. An extractor nozzle according to claim 22, further comprising a bearing mounted in a first end wall of the turbine housing, remote from the suction tube and between the rotor and the gear train, wherein the turbine rotor is fixed on an axle that is rotatably mounted in the bearing and that extends through and beyond the first end wall, a portion of the axle extending beyond the first end wall has helical gear teeth provided thereon that engage and drive the gear train, the helical gear teeth being twisted about the axle such that under load the helical gear teeth apply a generally axial load on the axle in a direction away from the turbine outlet.

24. An extractor nozzle according to claim 23, wherein the turbine rotor has a centrally located recess in a surface of the rotor facing the first end wall of the turbine housing, the first end wall has a central raised portion that extends into the recess, and the bearing is mounted in the central raised portion such that the bearing is at least partially received in the recess in the rotor.

25. An extractor nozzle having an agitator and an air turbine operatively connected to the agitator for driving the agitator, the turbine having at least one ambient air inlet opening and an outlet opening, wherein the improvement comprises:

a suction tube having the extractor nozzle attached to a first end thereof, a second end of the suction tube being adapted for connection to a suction inlet of a wet pickup suction cleaner;

a turbine exhaust opening in the suction tube in fluid communication with the turbine outlet opening, whereby when suction is applied to the suction tube air is drawn through the turbine for driving the agitator; and a turbine outlet baffle extending from an edge of the turbine outlet opening proximate the extractor nozzle into the suction tube and over and beyond the turbine outlet opening, the end of the baffle remote from the nozzle being open for providing fluid communication between the turbine outlet opening and the suction tube, and suction openings passing through opposing sides of the baffle for providing further fluid communication between the turbine outlet opening and the suction tube.

26. An extractor nozzle according to claim 25, wherein a first portion of the suction tube between the baffle and the extractor nozzle has a cross-sectional area that is less than the cross-sectional area of a second portion of the suction tube on a side of the baffle remote from the extractor nozzle.

27. An extractor nozzle according to claim 25, further comprising a raised floor in the suction tube that extends from the nozzle to the baffle, the raised floor being arranged relative the suction openings in the baffle such that the raised floor directs air, liquid and debris traveling through the suction tube substantially over and beyond the suction openings.

28. An extractor nozzle according to claim 27, wherein the raised floor reduces the cross-sectional area of the first portion of the suction tube relative the second portion of the suction tube.

29. An extractor nozzle according to claim 27, wherein the raised floor extends along a plane that is located on a side of the suction openings in the baffle remote from the turbine, and shoulders are formed in opposing sides of the baffle, the shoulders extend generally longitudinally in the suction tube and are located between the suction openings and an inner surface of the suction tube, portions of the shoulders upstream of the suction openings curve toward the raised floor such that the upstream ends of the shoulders are substantially flush with an inner surface of the raised floor, whereby drops of liquid adhering to and traveling along the inner surface of the raised floor toward the baffle adhere to the shoulders and are directed around and beyond the suction openings and are substantially prevented from entering the turbine.

30. An extractor nozzle according to claim 25, wherein the suction openings in the sides of the baffle are slots passing through opposing sides of the baffle, the slots extend generally longitudinally in the suction tube and are open at the end of the baffle remote from the nozzle.

31. A turbine powered suction nozzle having a wet pickup suction nozzle with a suction inlet and an outlet communicating with a suction tube adapted for connection to a vacuum source, an agitator, a turbine operatively connected to the agitator for driving the agitator, the turbine having at least one turbine inlet communicating with ambient atmosphere and a turbine outlet communicating with the suction tube, whereby the turbine is driven by the vacuum source, wherein the improvement comprises:

a baffle extending from an edge of the turbine outlet proximate the wet pickup nozzle into the suction tube and over and beyond the turbine outlet to direct air, liquid and debris exiting the outlet of the suction nozzle over and beyond the turbine outlet, and thereby substantially preventing liquid and debris from entering the turbine outlet, an end of the baffle remote from the pickup nozzle being open for providing fluid communication between the suction tube and the turbine outlet, and slots passing through opposing sides of the baffle for providing further fluid communication between the suction tube and the turbine outlet.

32. A turbine powered suction nozzle according to claim 31, further comprising a wall extending transversely across the suction tube between the baffle and the pickup nozzle, said wall being arranged to direct air and debris traveling through the suction tube past the slots in the sides of the baffle.

33. A turbine powered suction nozzle according to claim 31, wherein the open end of the baffle and the slots in the sides of the baffle are spaced from an inner surface of the suction tube to prevent any liquid pooling in the suction tube from entering the turbine outlet.

34. A turbine powered suction nozzle according to claim 33, further comprising longitudinally extending shoulders in opposing sides of the baffle located between the slots and the inner surface of the suction tube, ends of the shoulders proximate the pickup nozzle being curved toward the wall in the suction tube such that the ends of the shoulders proximate pickup nozzle are substantially flush with an inner surface of the wall.

35. A compact hand held extractor nozzle with air turbine powered scrub brushes, said hand held extractor nozzle comprising:

a suction tube having a suction nozzle mounted on one end thereof, a second end of the suction tube defining a hand grip;

the scrub brushes comprise a pair of counter-rotating vertical axis rotary scrub brushes located adjacent to the nozzle;

the air turbine being located between the scrub brushes and the suction tube, the turbine having at least one turbine inlet communicating with ambient atmosphere and a turbine outlet communicating with the suction tube; and a gear train drivingly connecting the turbine with the brushes.

36. A hand held extractor nozzle according to claim 30, wherein the turbine comprises:

a generally disc-shaped turbine housing having a first end wall adjacent and generally parallel to the suction tube, a second end wall parallel to and spaced from the first end wall, and a peripheral wall joining the first and second end walls enclosing a generally disc-shaped turbine chamber; and a generally disc-shaped turbine rotor rotatably mounted in the turbine chamber.

37. A hand held extractor nozzle according to claim 36, wherein said at least one turbine inlet is located in the peripheral wall; and the turbine outlet is centrally located in the first end wall and fluidly communicates an eye of the turbine with the suction tube.

38. A hand held extractor nozzle according to claim 36, wherein the turbine further comprises an outlet baffle for directing air, liquid and other debris traveling through the suction tube over and beyond the turbine outlet to substantially prevent the liquid and debris from entering the turbine outlet and fouling the turbine.

39. A hand held extractor nozzle according to claim 38, wherein the turbine baffle comprises a first portion that extends from an upstream edge of the turbine outlet into the suction tube and a second portion that extends down stream from the first portion over and beyond the turbine outlet, a downstream end of the baffle being open for providing fluid communication between the suction tube and the turbine outlet.

40. A hand held extractor nozzle according to claim 39, further comprising suction openings passing through opposing sides of the baffle for providing further fluid communication between the suction tube and the turbine outlet.

41. A hand held extractor nozzle according to claim 40, further comprising a raised floor in the suction tube upstream of the baffle, the raised floor being positioned and arranged to direct air, liquid and debris traveling through the suction tube past the suction openings in the sides of the baffle.

42. A hand held extractor nozzle according to claim 41, wherein the raised floor is located in a plane located on a side of the suction openings remote from the turbine;

shoulders are formed in opposing sides of the baffle, the shoulders are located between the suction openings and an inner surface of the suction tube and extend generally longitudinally in the suction tube, portions of the shoulders upstream of the suction openings curve toward the raised floor such that the upstream ends of the shoulders are substantially flush with an inner surface of the raised floor, whereby drops of liquid traveling on the raised floor toward the baffle adhere to the shoulders and are directed around and beyond the suction openings in the baffle.

* * * * *